US005992629A

United States Patent [19]

Gullord et al.

[11] Patent Number: 5,992,629

[45] Date of Patent: Nov. 30, 1999

[54] AUDIBLE MESSAGE PRIZE ASSEMBLY AND ITS MANUFACTURE

[75] Inventors: Tina M. Gullord; William E. Archibald, both of Maple Grove, Minn.

[73] Assignee: General Mills Inc., Minneapolis, Minn.

[21] Appl. No.: 08/900,143

[22] Filed: Jul. 28, 1997

[51] Int. Cl.[6] ..... G08B 21/00; G09G 5/00

[52] U.S. Cl. ..... 206/459.1; 206/457; 340/540; 340/692

[58] Field of Search ..... 206/217, 218, 206/457, 459.1, 701; 340/540, 541, 546, 555, 568, 571, 572, 691, 692, 384.1, 384.3; 426/112

[56] References Cited

U.S. PATENT DOCUMENTS

| | | | |
|---|---|---|---|
| 3,930,249 | 12/1975 | Steck et al. | 340/540 |
| 4,255,745 | 3/1981 | Rohan et al. | 340/546 |
| 4,617,556 | 10/1986 | Rivera et al. | 340/546 |
| 5,099,232 | 3/1992 | Howes | 206/217 |
| 5,130,696 | 7/1992 | Liebman | 340/540 |
| 5,283,567 | 2/1994 | Howes | 206/217 |
| 5,439,103 | 8/1995 | Howes | 206/217 |
| 5,464,092 | 11/1995 | Seeley | 206/217 |
| 5,625,347 | 4/1997 | MacLean et al. | 340/540 |

*Primary Examiner*—Jimmy G. Foster
*Attorney, Agent, or Firm*—John A. O'Toole; L. MeRoy Lillehaugen; Alan D. Kamrath

[57] ABSTRACT

A light-activated, sound-providing device (122) is slideably received in a cavity (64) formed in an insert (52) of a size and shape for receipt in the hollow volume of a container (10) with a friction fit. The insert (52) has a volume generally corresponding to the volume of consumer food product which would normally be received in the container (10). The provisions (50) for retaining the sound-providing device (122) includes a paperboard medallion (60) secured to the insert (52) including text and graphics (62). In a preferred form, the sound-providing device (122) is not activated while in the interior of the closed container (10) but when the container (10) is opened by removal of its closure layer (13), the sound-providing device (122) is activated providing a sound for prize announcement, attention getting, or a similar function. In the preferred form, the containers (10) are interconnected in an array, with one of the containers (10) in a middle row including the sound-providing device (122) and the other containers (10) in the middle row including provisions (66) generally of the same size, weight, and volume as the retaining provisions (50) and the sound-providing device (122). The remaining containers (10) in the array are filled with a consumer food product such as yogurt.

20 Claims, 1 Drawing Sheet

2
13
23
124
125
122
134
123
122
14
13
50
64
123
125
124
60
12
10
62
24
52
18
54
22
21
20
15
17
16
29
19
60
64
56
62
50
52
54
70
58
110
13
44
38
13
44
66
68
62
13
14
44
46
40
12
14
12
13
40
44
46
42
38
46
38
46
42
40
24
24
32
36
24
18
42
42
40
36
34
18
10
22
22
28
20
32
22
26
20
10
30
10
28
20
10
20
10
26
2

AUDIBLE MESSAGE PRIZE ASSEMBLY AND ITS MANUFACTURE

BACKGROUND

The present invention generally relates to assemblies providing a sound when exposed to light and their method of manufacture, specifically relates to assemblies intended to be placed in closed packages and containers and in a preferred form which provide a sound when the package or container is opened, and particularly in the most preferred form to assemblies which audibly announce the winning of a prize when the package or container is opened.

Due to the fierce competition in the marketing of consumer food items such as breakfast cereals, yogurt, and the like, it is the practice of many food manufacturers to include a premium with the food product to promote the sale of the product beyond the marketability of the product itself. It can certainly be appreciated that such promotional devices must meet several requirements. First, as such devices are typically given away with the product, such devices must be relatively inexpensive to manufacture. Additionally, such devices must have the ability to be easily included with the product without disruption of the normal handling of such product. Thus, it is desirable that the promotional device be includable with the product without requiring different containers, boxes, cartons, or the like, which would increase the cost of product production. Similarly, the promotional device should not require special handling or care by the manufacturer and retailer of the product beyond that normally given the product without the promotional device. But most important, the promotional device should have consumer appeal to maximize the promotional value of the device.

The prize announcement assembly as shown and described in U.S. patent application Ser. No. 08/861,042 filed May 21, 1997, which is hereby incorporated herein by reference, represented a major advancement in the field of promotional devices. However, the prize announcement assembly disclosed therein has particular application for food products such as breakfast cereals or the like which are contained in bags located in packaging. Its application to other types of food products such as consumer food products having thixotropic properties such as yogurt is limited.

Thus, a need continues to exist for unique marketing techniques for increasing the appeal and desirability of products and which can be economically included with the product and which meet the requirements of promotional devices in the trade.

SUMMARY

Surprisingly, the present invention solves this need and other problems in the field of promotional devices by providing, in the preferred form, a sound-providing device slideably received in a cavity formed in an insert of a size and shape for receipt in the hollow volume of a container with a friction fit, with the insert having a volume generally corresponding to the volume of consumer food product which would normally be received in the container, with the upper opening of the container being removably closed by an opaque closure layer.

In a preferred aspect, the sound-providing device is placed within the interior of a container and in its most preferred form the sound-providing device is not activated in the container while in its closed condition and is activated as soon as the container is opened.

It is thus an object of the present invention to provide a novel assembly for providing a sound in connection with the marketing of products.

It is further an object of the present invention to provide a novel method for manufacturing a sound-providing assembly for use in connection with the marketing of products.

It is further an object of the present invention to provide such a novel sound-providing assembly for increasing the marketability of products beyond the attributes of the product itself.

It is further an object of the present invention to provide such a novel sound-providing assembly which significantly increases the enthusiasm that consumers view products, with all or only some of such products including sound-providing assemblies.

It is further an object of the present invention to provide such a novel sound-providing assembly which can be easily manufactured, handled, and manipulated.

It is further an object of the present invention to provide such a novel sound-providing assembly which can be placed in packages in low tolerance operations.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figures 1, 2:
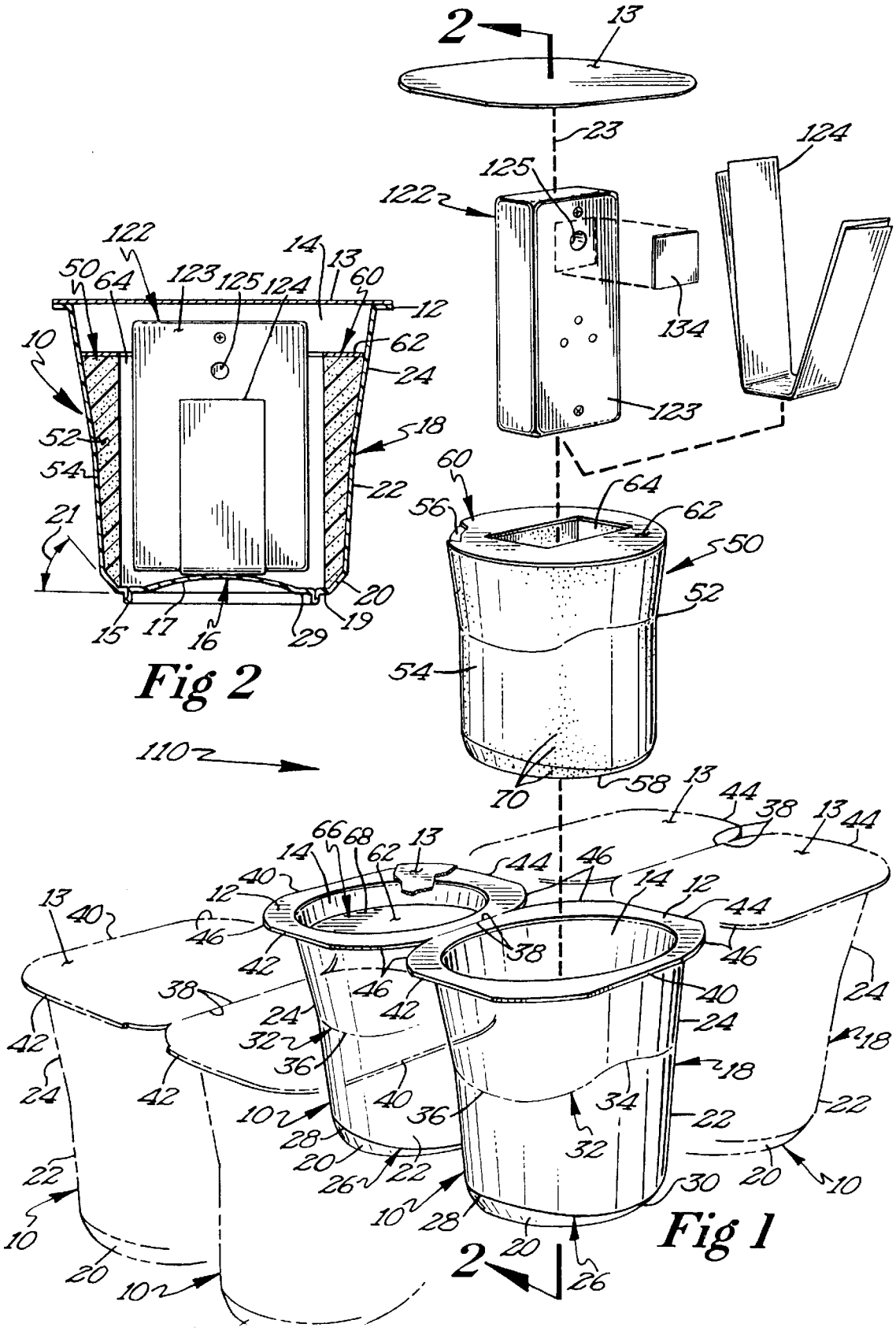
FIG. 1 shows an exploded, perspective view of a sound-providing assembly according to the preferred teachings of the present invention, with portions shown in phantom.
FIG. 2 shows a cross-sectional view of the sound-providing assembly of FIG. 1 but in an assembled condition according to section line 2—2 of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "front", "back", "treart", "upper", "lower", "height", "width", "length", "ten", "side", "lateral". "longitudinal", and similar terms are used herein, it should be understood that these terms have reference only to the structure shown in the drawings as it would appear to a person viewing the drawings and are utilized only to facilitate describing the illustrative embodiment.

DESCRIPTION

An audible message prize assembly manufactured according to the preferred teachings of the present invention is shown in the drawings and generally designated 110. Assembly 110 generally includes a light activated sound-providing device 122. Generally, device 122 has a housing 123 of a right parallelepiped shape including flat upper and lower surfaces. In the most preferred form, device 122 is of a sufficient size so as to prevent accidentally being ingested by a consumer, particularly a small child. Such embodiments, of course, find particular suitability for use in connection with packages or containers 10 for consumer food items such as yogurt. Device 122 further includes provisions for producing or providing a sound when a light sensor 125 is exposed to light. It should be appreciated that device 122 can be used as a toy premium itself, with the sound provided by device 122 increasing the amusement or play value of device 122. For example, housing 123 of device 122 could be fabricated in the shape of a figurine or the like, with light sensor 125 positioned proximate the eyes of the figurine. By covering and uncovering the eyes of the figurine or in other words light sensor 125 of device 122, sound could be produced by device 122 such as a sound in the form of a roar or similar sound appropriate with the shape of housing 123 of device 122. Also, assembly 110 can be used as a prize announcement with device 122 providing a sound in the form of an audible announcement or similar communication that a sweepstakes prize has been won by virtue of purchase of container 10. However, assembly 110 can be used in other manners where device 122 simply functions to get attention to assembly 110, the contents of container 10, or the like.

In the most preferred form, assembly 110 further includes a certificate 124 printed on paper stock. Certificate 124 can be in the form of a coupon for the future purchase of a food consumer item, a printed message such as a prize announcement, the message itself could be the prize, or the like. In the most preferred form, certificate 124 is folded in a U-shape including first and second, planar legs upstanding from a planar central portion. The sound-providing device 122 can be located between the first and second legs of certificate 124. Specifically, the first leg has a length approximating and preferably generally equal to the length of the upper surface of device 122. The second leg has a length substantially less than the length of the lower surface of device 122 and specifically slightly over one-half of the length of the lower surface of device 122.

In commercial practice, a removable, exterior, opaque label 134 is adhered to or otherwise positioned on housing 123 in a manner to overlay light sensor 125 of device 122. It can be appreciated that when light sensor 125 of device 122 is exposed to light, device 122 provides a sound. By placing label 134 over light sensor 125, device 122 is not activated even though device 122 is exposed to light. Thus, premature exhaustion of the battery or other energy source of device 122 does not occur during handling and manipulation of device 122 in the fabrication of assembly 110. Similarly, repetitive sound activation from multiple devices 122 during handling, manipulation, and fabrication of a plurality of assemblies 110 would possibly be annoying and undesirable. Also, device 122 can be stored or transported in lighted environments for extended periods of time without causing device 122 to be activated.

Assembly 110 according to the teachings of the present invention includes provisions 50 for retaining certificate 124 and/or device 122 in container 10 for a consumer food item and preferably a refrigerated food item, with container 10 being of a standard shape. In the preferred form, container 10 holds consumer food products having thixotropic properties such as yogurt and in the most preferred form is of the type shown and described in U.S. Pat. No. Des 369,971 and U.S. patent application Ser. No. 08/523,671, which are hereby incorporated herein by reference. For purpose of explanation of the basic teachings of the present invention, the same numerals designate the same or similar parts in the present figures and the figures of U.S. patent application Ser. No. 08/523,671. The description of the common numerals and container 10 may be found herein and in U.S. patent application Ser. No. 08/523,671.

Generally, container 10 includes a generally planar, annular flange 12 having a thickness generally equal to the uniform thickness of the stock sheet thermoplastic material utilized to form container 10. The inner edge of flange 12 defines an upper opening 14 which in the most preferred form is generally oval shaped for ease of introducing a spoon through opening 14 and into the hollow volume. In the most preferred form, opening 14 has a longitudinal extent which is generally 120% of the lateral extent. Flange 12 is utilized to adhesively receive a suitable closure layer 13 on the upper surface thereof and which extends over and closes opening 14. Closure layer 13 is opaque and in the most preferred form is formed of a metallic foil or a paper stock. Flange 12 includes an upper surface which can be planar or which could include an integral, annular, upwardly projecting ridge surrounding opening 14 for aiding in sealing closure layer 13 therewith. Flange 12 is adapted for abutment with suitable provisions in a carton which holds a plurality of such containers 10.

Container 10 further includes a generally planar base panel or bottom 16 which is parallel to and spaced from flange 12. In the most preferred form, bottom 16 has a periphery which is generally circular in shape and having a diameter which is slightly less than the lateral extent of opening 14 and in the most preferred form is generally 90% of the lateral extent of opening 14. In the most preferred form, bottom 16 may include a circular standoff ridge 15 formed during thermoforming of container 10. Ridge 15 is located radially inwardly and concentrically within the outer periphery of bottom 16 to define a planar, annular portion 19 extending between the periphery of bottom 16 and ridge 15. Ridge 15 acts as a pilot in stacking and partially nesting containers 10 on a lower carton including other containers 10 to aid in prevention of undesired movement from a stacked condition. Bottom 16 can also include a central dome-shaped portion 17 located radially inward and concentrically within the outer periphery of bottom 16 and of circular standoff ridge 15 and formed during thermoforming of container 10. A planar, annular portion 29 extends between ridge 15 and the outer periphery of dome-shaped portion 17.

Container 10 further includes a sidewall 18 which is generally cylindrical shaped and in the most preferred form tapers toward bottom 16 and has a generally frustoconical shape. Sidewall 18 according to the preferred teachings of the present invention is formed by the intersection of three curved planar surfaces of different cross sections. A curved planar surface is one which when cut along a height dimension can be unrolled or opened out into a planar piece without distortion or in other words is formed by a flat piece which has been curved and its ends interconnected to form a loop or annular member. In particular, sidewall 18 includes a bottom portion 20 intersecting and interconnecting with bottom 16, a middle portion 22 intersecting and interconnecting with bottom portion 20, and an upper portion 24 intersecting and interconnecting with and located between middle portion 22 and flange 12. It should be appreciated that curved planar surfaces of different cross sections intersect in a curved intersection line hereinafter referred to as a spline.

Bottom portion 20 is generally frustoconical shaped having cross sections corresponding to the periphery of bottom 16 which is generally circular in the most preferred form and of a size equal to the periphery of bottom 16 at its intersection and interconnection and of a linearly increasing size dependent on increased spacing from bottom 16. In the most preferred form, bottom portion 20 extends at an angle 21 in the order of 150° outwardly from bottom 16 or in other words 60° from the height axis 23 of container 10. It can then be appreciated that bottom portion 20 acts as a chamfered edge between sidewall 18 and bottom 16 to reduce the prospect of thinning out at the intersection of bottom 16 and sidewall 18 that could occur if the intersection were at a sharp angle such as 90° to bottom 16.

Upper portion 24 is generally frustoconical shaped having oval cross sections different from the shape of the cross sections of portion 20 and of a size generally equal to opening 14 at its intersection and interconnection to flange 12 and of a decreasing size linearly dependent on increased spacing from flange 12 and of an increasing size linearly dependent on increased spacing from bottom 16. In the most preferred form, upper portion 24 extends inwardly at an angle in the range of 5° to 8° from height axis 23 of container 10.

Middle portion 22 is generally frustoconical shaped having oval cross sections different from the shape of the cross sections of portions 20 and 24 and of a decreasing size linearly dependent on increased spacing from flange 12 and of an increasing size linearly dependent on increased spacing from bottom 16. In the most preferred form, middle portion 22 extends at an angle less than the angle of upper portion 24 from height axis 23 of container 10 and in the most preferred form in the range of 2°–3° from height axis 23 of container 10. Further, the oval cross sections of middle portion 22 in the most preferred form are less oval shaped, i.e. the ratio of the shape in the longitudinal direction versus the lateral direction being smaller and more cylindrical shaped than the oval cross sections of upper portion 24.

It can then be appreciated that middle portion 22 and bottom portion 20 intersect and interconnect at a curved intersection line or spline 26 having varying spacing from the periphery of bottom 16 with its greatest spacing from the periphery of bottom 16 at its high points 28 in the longitudinal direction at the longitudinal front and back of container 10 and its smallest spacing from the periphery of bottom 16 at its low points 30 in the lateral direction at the lateral sides of container 10. Similarly, middle portion 22 and upper portion 24 intersect and interconnect at a curved intersection line or spline 32 having varying spacing from the periphery of bottom 16 with its greatest spacing from the periphery of bottom 16 at its high points 34 in the lateral direction at the lateral sides of container 10 and its smallest spacing from the periphery of bottom 16 at its low points 36 in the longitudinal direction at the longitudinal front and back of container 10.

In the most preferred form, bottom 16 and sidewall 18 are symmetrical about the longitudinal axis and also symmetrical about the lateral axis. Further, sidewall 18 of container 10 generally tapers from opening 14 to the periphery of bottom 16 creating container 10 having a greater overall height than a similar container having the same size opening as opening 14 but with non-tapering sidewalls. Thus, container 10 according to the preferred teachings of the present invention can be formed, filled, and sealed in the same packaging line as prior shorter containers of generally the same volume.

In production of containers 10 according to the teachings of the present invention, the stock sheet thermoplastic material is extended over a cavity, with at least the portions of the material extending over the cavity being heated. It can then be appreciated that the cavity includes components corresponding to opening 14, bottom 16, and portions 20, 22, and 24 of container 10 desired to be produced. With the portions of the material located outward of the opening of the cavity and forming flange 12 being clamped or otherwise held, the portions of the material extending over the opening of the cavity is drawn into the cavity such as by vacuum and/or pressure and against the sidewall and bottom of the cavity to form container 10. In this regard, a plug assist technique can be utilized before or during the drawing step to pull material located outward of the opening of the cavity into the cavity to provide increased material for forming sidewall 18 and bottom 16.

In the preferred form, multiple containers 10 are marketed in cartons in arrays including multiple columns and rows and in the most preferred form including two columns and three rows. In this regard, flange 12 includes first and second, outer, parallel, straight, side edges 38 and 40 which are parallel to the longitudinal axis of container 10. Flange 12 further includes an outer, straight, front edge 42 which is parallel to the lateral axis of container 10 and arranged perpendicular to edges 38 and 40. In the most preferred form, arcuate corner edges 46 extend between the ends of edges 38 and 40 and edges 42 and 44. As illustrated in FIG. 1, in each row of the array of containers 10, edges 38 are interconnected together with a break-away connection and with edges 40 located on the outside of the array. Similarly, in one form, in each column of the array of containers 10, edges 42 and 44 are interconnected together with a break-away connection aside from the first container 10 in the column which has edge 42 free and the last container 10 in the column which has edge 44 free. In other preferred forms, the rows of containers 10 are not interconnected together but rather the rows are held in the array by the carton or other packaging for containers 10. Material between edges 46 of adjacent containers 10 in the array of containers 10 can be removed for ease of separation. It can then be appreciated that production in pairs or arrays is advantageous in filling, handling, and marketing containers 10, with filled, individual containers 10 being broken off by the consumer when desired. Flange 12 of the preferred form is then believed advantageous in fabricating containers 10 in pairs or arrays according to the preferred teachings of the present invention.

Retaining provisions 50 generally include an insert 52 having a side wall 54 of a size and shape for a slideable, friction fit in side wall 18 of container 10. Insert 52 further has spaced, opposed top and bottom, generally planar surfaces 56 and 58, respectively. Bottom surface 58 has a size and shape for generally abutting with bottom 16 of container 10 when side wall 54 of insert 52 fits and flushly abuts with side wall 18 of container 10 with a friction fit. Insert 52 is formed of material which is deformable but generally retains its shape such as U.S. Federal Drug Administration food contact gasket material and in the most preferred form of inert silicone material. In the most preferred form, insert 52 is formed by hand pouring or by injecting uncured gasket material into a negative mold and allowing the gasket material to harden into the shape of the negative mold which corresponds to the interior shape of side wall 18 of container 10. Injection molding may be preferable for weight consistency in the fabrication of multiple inserts 52.

Retaining provisions 50 further include a medallion 60 suitably secured to top surface 56 of insert 52 such as by adhesive. In the most preferred form, medallion 60 is fabricated from a paperboard or other paper stock material. The upper side of medallion 60 opposite insert 52 can be printed with and serves to display suitable text and graphics 62. The side edge of medallion 60 has a shape and size corresponding to the shape and size of side wall 54 at top surface 56 of insert 52 and of the portion of side wall 18 against which it abuts.

Provisions 50 further include a cavity 64 extending axially aligned and through medallion 60 and into insert 52 and in the most preferred form extending axially between surfaces 56 and 58 of insert 52. Cavity 64 has a size and shape for slideable receipt of certificate 124 and/or device 122. In the most preferred form with housing 123 in the shape of a right parallelepiped, cavity 64 has rectangular cross sections of a constant size and specifically having a length and width greater than the length and width of the cross sections of housing 123.

The height of provisions 50 is less than the height of container 10 and is generally equal to the height of yogurt in container 10 in a standard fill volume. Thus, when provisions 50 are located in container 10, a head space exists between the upper side of medallion 60 and the inner surface of closure layer 13 and is generally equal to the head space that exists between the upper surface of yogurt and the inner surface of closure layer 13 for a typical product sold and in the most preferred form has a gap height of about 9 mm.

In the preferred form, housing 123 of device 122 has a height slightly greater than cavity 64 and of provisions 50 and less than the height of container 10 and in the most preferred form, has a height about 2 mm greater than the height of cavity 64 and of provisions 50 and 7 mm less than the height of container 10. Thus, housing 123 of device 122 extends into the gap between provisions 50 and closure layer 13 but is spaced from closure layer 13 a distance equal to about 80% of the gap.

In the preferred form, assembly 110 is provided in only select number of products intended to be retailed and in a random manner. Additionally, when the product is sold in an array of two columns and three rows, provisions 50 together with certificate 124 and/or device 122 are provided in container 10 in the middle row, with containers 10 of the other rows holding the consumer food product such as yogurt. Further, typical yogurt filling devices fill two containers 10 simultaneously. As certificate 124 and/or device 122 together with provisions 50 are located in one of containers 10 in the row and it is not desired to additionally attempt to fill yogurt in the same container 10, it is desirable to skip filling the entire row including container 10 which includes or will include certificate 124 and/or device 122 together with provisions 50. As it is desired that detection of device 122 can generally occur only upon opening of closure layer 13 of container 10 including device 122, device 110 includes provisions 66 for filling the other containers 10 in the row having container 10 which includes device 122 with generally the same weight and volume as container 10 which includes device 122 and generally as the containers 10 in the other rows filled with yogurt. In the most preferred form, provisions 66 include insert 52 of the same size and shape and most preferably of identical construction as in provisions 50 (including having cavity 64) for ease of production and inventory. Provisions 66 further include a medallion 68 of generally the same construction as medallion 60 but not including cavity 64 extending therethrough. Thus, medallion 68 covers cavity 64 of insert 50 in provisions 66. Text and graphics 62 of medallion 68 could include an indication to open container 10 which includes device 122 and/or other desired promotional information.

In the most preferred form, inserts 52 are dusted with edible corn starch 70 to facilitate insertion and removal of provisions 50 and 66 from containers 10. Similarly, cavity 64 of provisions 50 can be dusted with corn starch 70 to facilitate insertion and removal of certificate 124 and/or device 122.

Now that the basic construction of assembly 110 according to the preferred teachings of the present invention has been set forth, a method of operation and some of the advantages of assembly 110 can be explained and appreciated. Specifically, provisions 50 and 66, device 122 and optionally certificate 124 are placed in empty containers 10 and afterwards, closure layers 13 sealed thereto. In the preferred form where assembly 110 is utilized in a prize announcement, attention getting, or similar function, label 134 is removed from device 122 before its insertion into cavity 64 just before the placement and sealing of closure layer 13. Containers 10 not including provisions 50 and 66, device 122 and optionally certificate 124 can also be filled with the desired consumer food product such as yogurt and sealed with closure layers 13 in the normal manner. Containers 10 can be interconnected or separated into pairs, arrays or individually. The normal packaging operation can then be continued including placing the sealed containers 10 into cartons and other packaging, and the like.

In the most preferred form, device 122 is positioned so that at least light sensor 125 of device 122 is positioned adjacent the upper surface of retaining provisions 50 and the top of container 10. It can be appreciated that retaining provisions 50 generally hold device 122 in position in the hollow volume or interior of container 10 and specifically generally prevents and at least severely restricts movement of device 122 in the interior of container 10.

It can be appreciated that when device 122 is located within the hollow interior or volume of container 10 in a closed condition by the sealing of layer 13 thereon and thus preventing passage of light into the interior thereof, device 122 is not exposed to light even though containers 10 are in a lighted environment. The individual, sealed containers 10 can be handled and retailed in a conventional manner. However, it can be appreciated that when a consumer removes layer 13 and opens container 10 in a lighted environment in the normal manner, light is allowed to pass into the interior of container 10 so that device 122 therein is exposed to light. Specifically, as device 122 is generally located adjacent the top of container 10 and cavity 64 does not conform to the shape of device 122, light typically will be allowed to pass between cavity 64 and device 122 or in any case device 122 will be exposed to light when device 122 is withdrawn from cavity 64. Thus, when container 10 is opened, the light is sensed by light sensor 125 of device 122 which is thereby activated to provide a sound such as an audible message. As an example, when assembly 110 is utilized in a prize announcement function, the sound provided by device 122 could be in the form of verbalizing the words "You won" together with the background sounds of cheers, applause, and the like.

Assembly 110 and its method of manufacture is particularly advantageous according to the teachings of the present invention. Specifically, provisions 50 and 66 can be easily manufactured, handled, and manipulated mechanically and/or manually in a relatively inexpensive manner by conventional packaging techniques without requiring any folding operations which must be formed manually or by complicated mechanisms. Additionally, devices 122 of a variety of shapes, sizes and configurations can be placed in cavities 64 of provisions 50 which act to position devices 122 proximate the top of containers 10. Positioning device 122 proximate the top of container 10 is especially important when assembly 110 is utilized in a prize announcement function so that device 122 provides the audible message when container 10 is initially opened by the consumer. Light sensor 125 of device 122 may be positioned in cavity 64 adjacent bottom 17 when container 10 and/or closure layer 13 while not being transparent are sufficiently translucent to allow enough light passage to activate light sensor 125 if positioned adjacent the top of container 10 even in a closed condition. However, the audible message may not be provided in this case until container 10 is opened and device 122 at least partially withdrawn from cavity 64. Thus, it would be preferable to utilize device 122 having light sensor 125 of a sensitivity which is not activated by light passing through container 10 and/or closure layer 13 in a closed condition even when located proximate the top of container 10 and which is only activated when container 10 is initially opened.

In the preferred form, the length and width of device 122 is less than the length and width of cavity 64 and in the most preferred form is relatively loose. This is particularly advantageous as certificate 124 and/or device 122 can be easily inserted in cavity 64 with low tolerance operation. Additionally, the height of device 122 is greater than the height of cavity 64 so that device 122 extends into the gap inside of container 10 between provisions 50 and closure layer 13. Although a discerning consumer might be able to tell that device 122 is within a particular container 10 such as the result of movement of device 122 within container 10 due to its relatively smaller size than cavity 64 or as the result of manually deflecting closure layer 13 into device 122 located in cavity 64, the benefits from the relatively simple and uniform fabrication of assembly 110 according to the teachings of the present invention are believed to overshadow its potential shortcomings.

The inclusion of premiums, prizes, or the like to increase the marketability of products beyond the attributes of the product itself is a well-known marketing technique. It is believed that the inclusion of devices 122 in containers 10 significantly increases the enthusiasm that consumers will view containers 10 due to the novelty of providing an audible message or similar sound to the consumer. Thus, assembly 110 increases the appeal and desirability of containers 10 and the product contained therein to the consumer to maximize the promotional value of container 10. Assembly 110 according to the teachings of the present invention provides a viable manner for easily including devices 122 in containers 10 with minor disruption of the normal handling of containers 10 and without requiring containers 10 to be different from containers 10 which are not intended to include assemblies 110. Additionally, assemblies 110 are relatively inexpensive to manufacture and can be manufactured and placed in a manner which is less costly in both labor and disruption of normal handling of containers 10. Therefore, assemblies 110 according to the teachings of the present invention provide an enhanced marketing technique for increasing the marketing of products.

Although assembly 110 has been shown and described in connection with container 10 which is believed to have particular advantages, assembly 110 according to the teachings of the present invention can be utilized with other types and forms of containers and packages. Similarly, although assembly 110 is disclosed including pairs of containers 10 interconnected together with breakaway connections, assembly 110 according to the teachings of the present invention can be utilized with multiple containers which are interconnected together or which are independent from each other and possibly retailed in arrayed multipacks or individually. Additionally, although disclosed in connection with promoting the sale of yogurt and other consumer food products having thixotropic properties, assembly 110 according to the teachings of the present invention may also be advantageous with products which do not retain their shape but rather tends to match the shape of the container or package in which it is present.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

We claim:

1. Assembly for providing a sound comprising, in combination: at least a first container for holding a consumer food product having thixotropic properties, with the container including a side wall defining a hollow volume and having an upper opening and terminating in a bottom, with the hollow volume having a height, with the container being opaque; a closure layer removably sealed to the container for closing the upper opening, with the closure layer being opaque; a light-activated, sound-providing device having a shape including a height, a width and a length, with the height of the light-activated, sound-providing device being less than the height of the hollow volume; and means for retaining the sound-providing device in the hollow volume of the container, with the retaining means including an insert of a size and shape for receipt in the hollow volume with a friction fit with the side wall, with the insert having a height less than the height of the hollow volume, with the insert including a cavity for slideable receipt of the sound-providing device, with the insert and sound-providing device received in the cavity having a volume generally corresponding to the volume of consumer food product which would normally be received in the container.

2. The assembly of claim 1 wherein the cavity has a height less than the height of the sound-providing device; and wherein a gap exists between the closure layer and the retaining means, with the sound-providing device extending from the cavity into the gap.

3. The assembly of claim 2 wherein the sound-providing device is spaced from the closure layer a distance equal to about 80% of the gap.

4. The assembly of claim 1 wherein the insert is formed of material which is deformable but generally retains its shape.

5. The assembly of claim 4 wherein the insert is formed of food contact gasket material.

6. The assembly of claim 5 wherein the insert is formed of inert silicone material.

7. The assembly of claim 1 further comprising, in combination: a certificate, with the certificate being slideably received with the sound-providing device in the cavity.

8. The assembly of claim 7 wherein the certificate is folded in a U-shape including first and second legs upstanding from a central portion, with the sound-providing device located between the first and second legs in the cavity of the insert.

9. The assembly of claim 8 wherein the sound-providing device includes upper and lower surfaces, with the first leg having a length generally equal to the length of the upper surface and the second leg having a length substantially less than the length of the lower surface.

10. The assembly of claim 1 further comprising, in combination: a second container interconnected to the first container with a break-away connection; and means for filling the second container with generally the same weight and volume as the retaining means of the first container.

11. The assembly of claim 10 wherein the filling means includes an insert of the same size and shape as the insert of the retaining means.

12. The assembly of claim 11 wherein the retaining means and filling means each further includes a medallion secured to the insert, with the medallion of the retaining means including a cavity aligned with the cavity of the insert, with the medallion of the filling means covering the cavity of the insert.

13. The assembly of claim 10 further comprising, in combination: a third container interconnected to the first container with a break-away connection; a fourth container interconnected to the second container with a break-away connection; a fifth container interconnected to the first container with a break-away connection opposite to the third container; and a sixth container interconnected to the second container with a break-away connection opposite to the fourth container, with the third container interconnected to the fourth container with a break-away connection and the fifth container interconnected to the sixth container with a break-away connection; with the third, fourth, fifth, and sixth containers holding the consumer food product.

14. The assembly of claim 10 wherein the first and second containers each further includes an annular flange integrally extending from the side wall opposite the bottom and having an inner edge defining the upper opening, with the break-away connection being formed between the annular flanges of the first and second containers.

15. The assembly of claim 1 further comprising, in combination: a dusting of corn starch on the insert and inside of the cavity to facilitate removal of the insert from the container and the sound-providing device from the cavity.

16. The assembly of claim 1 wherein the retaining means further includes a medallion secured to the insert, with the medallion including a cavity aligned with the cavity of the insert.

17. The assembly of claim 1 wherein the upper opening is generally oval shaped.

18. The assembly of claim 1 wherein the side wall generally tapers from the upper opening to the bottom.

19. The assembly of claim 1 wherein the bottom and the side wall are formed by a sheet of thermoplastic material having a substantially uniform thickness and thermoformed to form the hollow volume.

20. The assembly of claim 1 wherein the container further includes an annular flange integrally extending from the side wall opposite the bottom and having an inner edge defining the upper opening, with the closure layer extending over and being adhesively secured to the annular flange.

* * * * *